US005875489A

United States Patent [19]

Couto

[11] Patent Number: 5,875,489

[45] Date of Patent: Mar. 2, 1999

[54] DEVICE FOR ADJUSTING MEDICAL DEVICES

[76] Inventor: Karen P. Couto, 4401 Acushnet Ave., New Bedford, Mass. 02745

[21] Appl. No.: 971,648

[22] Filed: Nov. 17, 1997

[51] Int. Cl.[6] ..... A41D 13/00

[52] U.S. Cl. ..... 2/21; 223/101

[58] Field of Search ..... 2/163, 161.1, 161.6, 2/159, 160, 16, 17; 223/101

[56] References Cited

U.S. PATENT DOCUMENTS

| | | | |
|---|---|---|---|
| 450,447 | 4/1891 | Buchwalter | 2/21 |
| 513,724 | 1/1894 | Perkins | 2/21 |
| 718,652 | 1/1903 | McMillan | 2/21 |
| 922,954 | 5/1909 | Rives | 2/21 |
| 994,856 | 6/1911 | Mariner | 2/21 |
| 1,091,892 | 3/1914 | Poteat | 2/21 |
| 1,160,522 | 11/1915 | Morris | 2/21 |
| 1,380,960 | 6/1921 | Hmenia | 2/21 |
| 2,467,613 | 4/1949 | Davis | 2/21 |
| 2,538,889 | 1/1951 | Swarin | 2/21 |
| 3,371,561 | 3/1968 | Fabricant | 2/21 |
| 4,084,824 | 4/1978 | Kalivas | 2/21 |
| 5,224,363 | 7/1993 | Sutton | 2/2.5 |
| 5,507,041 | 4/1996 | Wright | 2/21 |
| 5,644,796 | 7/1997 | Laughlin | 2/161.6 |

FOREIGN PATENT DOCUMENTS

| | | | |
|---|---|---|---|
| 474150 | 10/1927 | Germany | 2/21 |
| 1132663 | 11/1968 | United Kingdom | 2/163 |

*Primary Examiner*—Amy Vanatta
*Attorney, Agent, or Firm*—Francis J. Clark

[57] ABSTRACT

A device for use in the medical community to facilitate changing the height of adjustable medical devices such as, canes, crutches, walkers and the like, adapted to fit the finger for depressing a retractable spring loaded pin located within adjustable medical devices such as canes, crutches, walkers and the like, to change the height of such medical devices.

3 Claims, 2 Drawing Sheets

DEVICE FOR ADJUSTING MEDICAL DEVICES

BACKGROUND OF THE INVENTION

Field of Invention

This invention relates generally to changing the height of adjustable medical devices and more specifically to a device that permits the changing of the height of medical devices such as canes, crutches, walkers and the like.

SUMMARY OF THE INVENTION

A device, made from plastic or metal or combinations thereof, for use in the medical community to facilitate changing the height of adjustable medical devices such as, canes, crutches, walkers and the like. The device is comprised of a hollow tubular body for placing over a human finger. The tubular body is made from metal or plastic and has a wall, the wall having inner and outer surfaces and an orifice therethrough, and a protuberance element extending through said orifice. The protuberance element is made from a soft yielding frictional material or rubber. The protuberance has a tapered portion which runs down to a flange at its base. The tapered portion of the protuberance passes through the orifice in the tubular body with the flange keeping in contact with the inner surface of the wall of the tubular body. With the device in place on the finger, the tapered portion of the protuberance extends out from the device and is used to depress a retractable spring loaded pin located within an adjustable medical device. The present invention permits an operator to place the device on the finger, put the protuberance in contact with the spring loaded pin, and depress the pin without difficulty, and then change the height of the medical device.

An object of the present invention is to provide a device that provides a tool to change the height of adjustable medical devices such as canes, crutches, walkers and the like.

An other object of the present invention is to provide a device that provides a tool to eliminate injuries to fingers, wrists or hands, when changing the height of medical devices.

An additional object is to provide the aforementioned objects in one device.

DESCRIPTION OF THE PREFERRED EMBODIMENT

Figure 1:
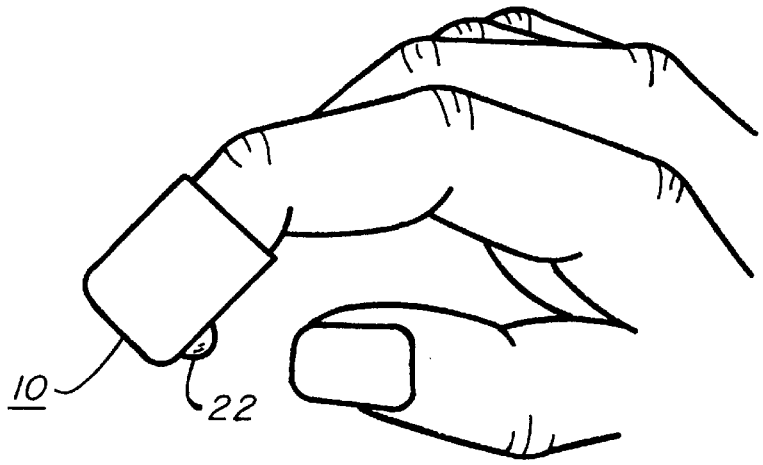
FIG. 1 is a view illustrating the device applied to the finger of the user.

The goal of the present invention is to provide a device for changing the height of adjustable medical devices, such as canes, crutches, walkers and the like.

There is a need in the medical community for a device to adjust canes, walkers and the like. The present invention provides such a device. Medical devices that are adjustable, such as canes, crutches, walkers and the like, have a retractable spring loaded pin located therein. These medical devices usually consist of two members, an inner stationary member and an outer slidable member. Both members being of a hollow tubular shape. The outer member slidable over the inner member, similar to a sliding trombone. The outer member has several holes drilled through it at specific intervals. The inner member has a retractable spring loaded pin situated therein which extends out through a hole in the outer member and when re-positioned in-line with another hole in the outer member will insert itself in that hole. Thusly, when it is in-line with one of the drilled holes in the outer member, the retractable single spring loaded pin inserts itself therein and becomes positioned at that position. The spring loaded pin in the inner member extends out through the outer member, through one of the drilled holes, and needs to be depressed for a person to move the outer member to a new position. The procedure required for a person to change the height of a cane with such members, is that the person must depress the spring loaded pin, of the inner member of the adjustable medical device, far enough into the inner member, using the present invention, so that it clears the hole in the outer member. This will cause the pin to pass beneath the wall of the outer member of the medical device. Once the pin is below the wall of the outer member, the outer member may then be slidably moved up or down for re-positioning, depending on what height is required. Thus, when the pin within the inner member is positioned in-line with another hole in the outer member, it, because of it being spring loaded, inserts itself therein, locking the slidable member or members at a new height. The present invention permits an operator to place the present invention on a finger, put the protuberance in contact with the spring loaded pin, and depress it without difficulty. The height of the outer member may then be changed. In normal operation, before the advent of this invention, operators pinched their fingers, broke finger nails or were unable to push the pin into the inner section far enough to permit changing the height of the adjustable medical device. The present invention has remedied such problems.

The present invention relates to a device to facilitate changing the height of adjustable medical devices such as canes, walkers, crutches, and the like. The device may be used by various people in and out of the medical community for changing the height of other devices that are adjustable, but was developed mainly for use in the medical community.

Figure 2:
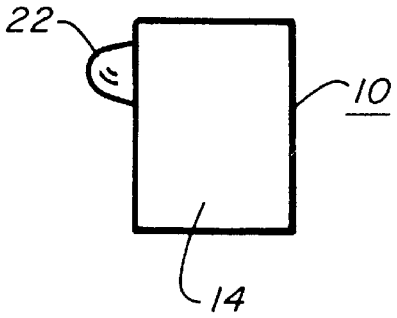
FIG. 2 is a side elevation.
Figure 3:
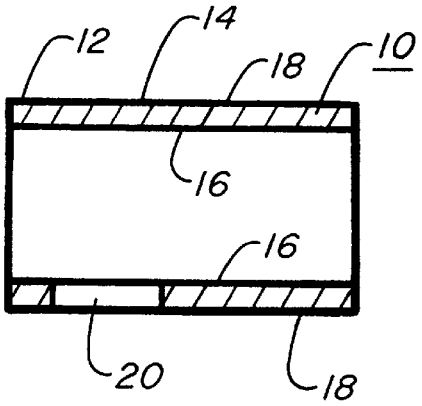
FIG. 3 is a longitudinal view of the device without the protuberance element.
Figure 4:
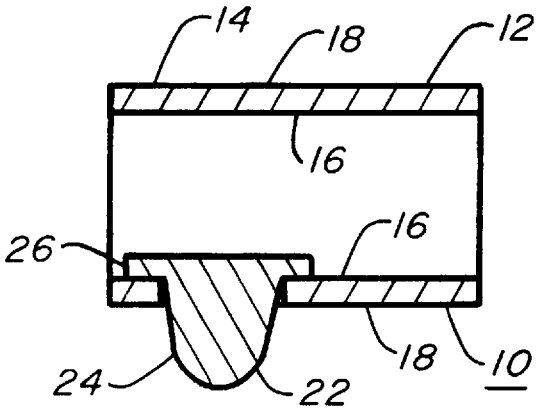
FIG. 4 is a cross-sectional view of the device and the protuberance element, illustrating the tapered body and flange of the protuberance element seated in position in the device.

The device 10 as shown in FIGS. 1, 2, 3 and 4, consists of a hollow tubular body 12 and a protuberance element 22. As shown in FIG. 3, the hollow tubular body 12 has a wall 14, the wall having inner 16 and outer 18 surfaces and an orifice 20 therethrough. FIG. 4 shows the hollow tubular body 12 with the protuberance element 22 seated therein and extending through the orifice 20 in the hollow tubular body 12. The tubular body 12 may be made from plastic or metal, while the protuberance 22 may be made from any frictional material, such as soft plastic or rubber. It is preferred that the protuberance be made from rubber. As shown in FIG. 1, the tubular body 12 is constructed to fit the finger with the protuberance 22 being located where ones finger pad would be.

The device 10 is one that may be used by various people in and out of the medical community. It is used to change the height of canes, walkers, crutches and the like or to remove legs attached to these devices so that wheels may be added.

The adjustment is usually done manually by pushing in a retractable spring loaded pin located within an inner stationary member of a cane, or walker etc. As mentioned in earlier paragraphs, the spring loaded pin, which is used to secure the height of a cane, projects out through one of several circular holes located in the outer slidable member of the cane. These holes are used to position the slidable member at different heights when adjusting the canes etc. Once the spring loaded pin is depressed into the inner member of the cane the slidable member of the cane is thereby released and may then be slidably moved up or down to change the height of the cane to the required height. Unfortunately, the pin in the cane sometimes becomes stuck requiring excessive force to be used which makes it additionally painful to the wrist, hand, and finger pad, to push it in. The spring-mounted pin is easily freed up with the present invention by using the side of the device, which is durable and hardy, to jar the pin loose for the adjustment.

People who own canes, walkers etc., are usually frail or impaired and usually cannot make the adjustments to their medical devices because they do not have the required strength and dexterity of the wrist, hand and fingers. With the present invention, adjustments to canes etc. are made easier and less painful and easy for these people. The device 10 is easily slipped onto one's index or middle finger, with the protuberance 22 protecting the pad of the finger. The protuberance 22 is then put into contact with the retractable spring loaded pin in the cane etc. permitting the spring loaded pin to be manually pushed in.

Figure 5:
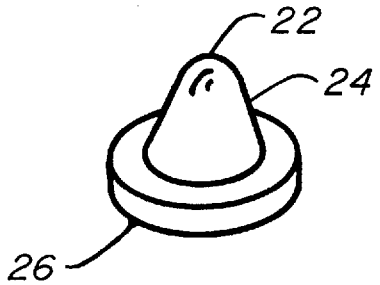
FIG. 5 is a detail of the frictional protuberance element.

In the drawings, the reference numeral 10 indicates the device which preferably is tubular in cross-section and conforms approximately to the shape of the human finger. It is tubular to afford adaptability to the finger and to provide ventilation to the finger so as to avoid the accumulation of perspiration and the generation of undue heat and, furthermore, to avoid compression of the finger and restriction of circulation of blood therein. When formed in this preferred shape, the device 10, as shown in FIG. 3 is provided with a hollow tubular body 12 and an orifice 20. The hollow tubular body 12 is for the insertion of a human finger and the orifice 20 for the seating of a protuberance 22 in the device 10. This protuberance element 22 as shown in FIGS. 4 and 5 consists of a tapered body 24 and a flange 26 at the base of the taper. The tapered body 24 is disposed within the tubular body 12 in the orifice 20, projecting through the orifice 20, as shown in FIGS. 2 and 4, with the protuberance 22 being confined by the flange 26, which engages the inner surface 16 of the wall 14 of the tubular body 12, and the orifice 20. As shown in FIG. 4., the tapered body 24 of the protuberance 22 is projected through the orifice 20, which is of slightly lesser diameter than the cross-sectional diameter of the base of the tapered body 24 and by application of a slight force and by reason of the resilient nature of the protuberance material, of which it is composed, compresses when forced through the orifice 20, causing the tapered body 22 to become seated within the device 10. The tapered body 22 as it recovers it's shape becomes seated in the orifice 20, so that it engages the inner and outer walls of the latter to be retained properly in place, in conjunction with the flange 26, as shown in FIG. 4.

As shown in FIG. 4, the tapered body 24 of the protuberance 22 projects slightly beyond the surface of the tubular body 12 of the device 10, such that a person using the device may engage a spring loaded pin, which is commonly situated within a medical device, such as a cane. The tubular body 12 is preferably made of a comparatively rigid material such as metal, plastic or other suitable material and the protuberance 22 is preferably made of rubber, which has the attribute of a sufficient adhesiveness or friction to properly engage the retractable pin of the cane, etc., without slipping off the pin, and a resiliency sufficient to hold it in place on the retractable pin. The device 10, thusly protects the finger, so that the latter is protected from irritating contact with the retractable pin, but provides the necessary frictional contact with the retractable pin so as to permit a person to depress the pin.

The device 10 has thus been found to be of great advantage in preventing injuries to the finger.

Figure 6:
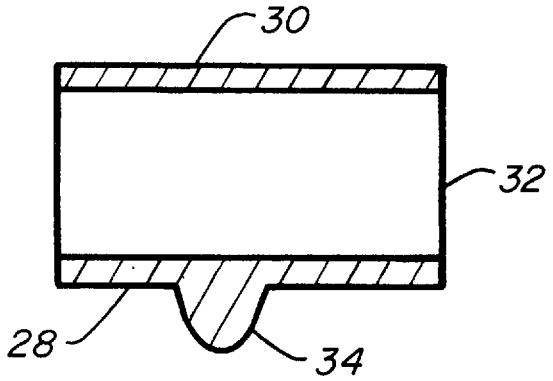
FIG. 6 is a detail of a similar device with the protuberance element incorporated therein.

Another version depicting a similar device is shown in FIG. 6. FIG. 6 shows a longitudinal view of a device 30, with a hollow tubular body 32, for the insertion of a finger, and a protuberance 34 as an integral member of the device 30. The device 30 may be used in the same manner as the present invention.

Still another version not shown would be that the protuberance would be adhered to the surface of the device in the position where a finger pad would be.

The present invention therefore provides a device which enables a person, who tends the elderly, or a person whether elderly, frail or otherwise physically impaired to readily adjust whatever medical device, such as a cane, crutches, walkers and the like, they may be using.

While the present invention is described for use in adjusting adjustable medical devices, such as canes, crutches, walkers and the like, it is obvious that the invention may be used for the adjusting of any device that uses a retractable spring loaded pin for adjustment.

Whereas, the present invention has been described in particular relation to the drawings attached hereto, it should be understood that other and further modifications of the invention, apart from those shown or suggested herein, may be made within the spirit and scope of this invention.

What is claimed is:

1. A device for depressing retractable spring loaded pins in medical devices comprising:

a tubular body for placing over a human finger; said tubular body having a wall, the wall having inner and outer surfaces and a protuberance element having a tapered body, the tapered body extending outwardly from the outer surface of the wall and disposed over the pad of the finger;

the protuberance element being made from a soft yielding frictional material to contact the retractable spring loaded pin and reduce slippage during depressing; and the tubular body being made from a rigid material.

2. The device of claim 1 wherein the wall has an orifice therethrough and the protuberance element has a flange, the flange being disposed within the tubular body and contacting the inner surface and the protuberance element extending through the orifice.

3. The device of claim 2 wherein the tubular body is a hollow cylinder.

* * * * *